US011466597B2

(12) United States Patent
Weber et al.

(10) Patent No.: US 11,466,597 B2
(45) Date of Patent: Oct. 11, 2022

(54) ELECTROMECHANICAL CAMSHAFT ADJUSTER

(71) Applicant: Schaeffler Technologies AG & Co. KG, Herzogenaurach (DE)

(72) Inventors: Jürgen Weber, Erlangen (DE); Peter Zierer, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 76 days.

(21) Appl. No.: 16/632,753

(22) PCT Filed: Jun. 13, 2018

(86) PCT No.: PCT/DE2018/100560
§ 371 (c)(1),
(2) Date: Jan. 21, 2020

(87) PCT Pub. No.: WO2019/020141
PCT Pub. Date: Jan. 31, 2019

(65) Prior Publication Data

US 2020/0165944 A1 May 28, 2020

(30) Foreign Application Priority Data

Jul. 25, 2017 (DE) ..... 10 2017 116 730.7

(51) Int. Cl.
*F01L 1/352* (2006.01)
*F01L 1/02* (2006.01)
*F01M 9/10* (2006.01)

(52) U.S. Cl.
CPC ..... *F01L 1/352* (2013.01); *F01L 1/024* (2013.01); *F01M 9/102* (2013.01)

(58) Field of Classification Search
CPC ... F01L 1/352; F01L 1/024; F01L 2001/3521; F01L 2820/032; F01L 1/34;
(Continued)

(56) References Cited

U.S. PATENT DOCUMENTS 9,334,762 B2 5/2016 Kuffner et al.
9,840,947 B2 12/2017 Kohrs et al.
(Continued)

FOREIGN PATENT DOCUMENTS

CN 101360890 2/2009
CN 104271901 1/2015
(Continued)

*Primary Examiner* — Devon C Kramer
*Assistant Examiner* — Kelsey L Stanek

(57) ABSTRACT

The disclosure relates to an electromechanical camshaft adjuster comprising an electric motor and an adjusting gear, which has a housing with two housing parts that are sealed off with respect to each other by means of a static seal and with respect to the electric motor and a cylinder head by means of two dynamic seals. A first housing part of the adjusting gear has a pot shape that tapers in a stepped manner towards a housing bottom of the housing part, said pot shape having three different inner diameter regions. In the region closest to the bottom with the smallest inner diameter, a stop plate that acts in the circumferential direction is held. In the region with the middle inner diameter, an output ring gear is mounted with play, and in the region with the largest inner diameter, an input ring gear is secured.

19 Claims, 5 Drawing Sheets

(58) Field of Classification Search
CPC .. F01L 2001/0476; F01M 9/102; F02B 75/04; F16H 57/00; F16H 57/029
USPC ..... 123/90.15; 415/173.4, 174.4
See application file for complete search history.

(56) References Cited

U.S. PATENT DOCUMENTS

| | | | | |
|---|---|---|---|---|
| 2010/0154732 | A1 | 6/2010 | Bayrakdar | |
| 2012/0145104 | A1* | 6/2012 | David | F01L 1/352 123/90.17 |
| 2013/0008398 | A1* | 1/2013 | Stoltz-Douchet | F01L 1/356 123/90.15 |
| 2013/0019825 | A1* | 1/2013 | Fischer | F01L 1/352 123/90.15 |
| 2014/0366821 | A1 | 12/2014 | David et al. | |
| 2017/0254235 | A1* | 9/2017 | Pluta | F16H 57/082 |

FOREIGN PATENT DOCUMENTS

| | | | | |
|---|---|---|---|---|
| CN | 105612316 | | 5/2016 | |
| DE | 10248355 | A1 | 4/2004 | |
| DE | 102004062037 | A1 * | 7/2006 | F01L 1/352 |
| DE | 102004062037 | A1 | 7/2006 | |
| DE | 102014216504 | A1 | 3/2015 | |
| DE | 102014213130 | A1 | 1/2016 | |
| DE | 102015120170 | A1 | 6/2016 | |
| EP | 2282020 | A1 | 2/2011 | |
| EP | 2463485 | A1 | 6/2012 | |
| JP | 2016044652 | A * | 4/2016 | F01L 1/3442 |
| WO | 2017021369 | A1 | 12/2017 | |

* cited by examiner

ELECTROMECHANICAL CAMSHAFT ADJUSTER

CROSS REFERENCE TO RELATED APPLICATIONS

This application is the U.S. National Phase of PCT Application No. PCT/DE2018/100560 filed on Jun. 13, 2018 which claims priority to DE 10 2017 116 730.7 filed on Jul. 25, 2017, the entire disclosures of which are incorporated by reference herein.

TECHNICAL FIELD

This disclosure relates to an electromechanical camshaft adjuster, which has an adjusting mechanism designed as a three-shaft mechanism and having a sealed two-part housing.

BACKGROUND

A camshaft adjuster of this kind is known from DE 10 2004 062 037 A1, for example. The known camshaft adjuster has an adjusting mechanism which is designed as a swash plate mechanism and is arranged outside a cylinder head. The housing of the adjusting mechanism is of two-part construction and is connected to a belt pulley. The adjusting mechanism is sealed off with respect to the environment by means of various sealing elements. A first seal is inserted between the two housing parts. A further seal, which is dynamic in contrast with the first seal, is inserted between one of the housing parts and the cylinder head. Moreover, a dynamic seal is provided which is arranged on the side of the adjusting mechanism facing away from the cylinder head and facing the servomotor of the camshaft adjuster. In different embodiments, this seal forms a seal either between a housing part and an adjusting shaft or between a housing part and a cover of the servomotor.

Another electromechanical camshaft adjuster is disclosed in US 2014/0366821 A1. In this case, a harmonic drive is provided as an adjusting mechanism. The adjusting mechanism is sealed off statically and dynamically by various seals. As in the case of the cited DE 10 2004 062 037 A1, lubrication of the adjusting mechanism with engine oil is envisaged.

DE 102 48 355 A1 discloses a camshaft adjuster having an electric drive, which has a double eccentric mechanism or a double planetary mechanism as an adjusting mechanism. The electric motor of the camshaft adjuster has a housing, which is assembled from an outer adjusting motor housing and an inner adjusting motor housing. The two housing parts, which are each referred to as an adjusting motor housing, are sealed off from one another and from a cylinder head by O-rings.

In a camshaft adjuster known from DE 10 2014 213 130 A1, a servomotor is arranged eccentrically with respect to an adjusting mechanism. The adjusting mechanism is sealed off by two static seals and two dynamic seals.

It is the underlying object of the disclosure to develop an electromechanical camshaft adjuster operating with a three-shaft mechanism beyond the prior art, in particular in respect of manufacturing aspects, while, at the same time, a compact construction should be ensured.

SUMMARY

According to the disclosure, this object is achieved by an electromechanical camshaft adjuster described herein and by a method for assembling an adjusting mechanism, designed as a harmonic drive, of an electromechanical camshaft adjuster also described herein. The advantages and embodiments of the disclosure which are explained below in conjunction with the assembly method also apply analagously to the device, i.e. the camshaft adjuster, and vice versa.

In a basic design which is known per se, the camshaft adjuster comprises an electric motor, in particular in the form of a brushless DC motor, and an adjusting mechanism which can be actuated by the electric motor and is designed as a three-shaft mechanism. The adjusting mechanism has a multi-part housing, wherein two housing parts, which are of different dimensions, are connected to one another in a fixed manner. The two housing parts can be sealed off from one another by at least one static seal, in particular a single static seal. Furthermore, two dynamic seals can be provided, and these seal off the housing of the adjusting mechanism from a cylinder head, on the one hand, and from the servomotor, i.e. the electric motor, on the other hand.

According to the disclosure, one of the two housing parts of the adjusting mechanism has a pot shape that narrows in a stepped manner toward a housing bottom of the housing part, said pot shape having three different inside diameter regions, wherein a stop washer that acts in the circumferential direction is held in the region closest to the bottom with the smallest inside diameter, an output ring gear of the adjusting mechanism is mounted with play in the region with the medium inside diameter, and an input ring gear is arranged in the region with the largest inside diameter, in particular being rigidly secured. The stop washer, the output ring gear and the input ring gear can be components of a harmonic drive. Alternatively, the adjusting mechanism can be designed as an inner eccentric mechanism, for example.

The electromechanical camshaft adjuster can be a camshaft adjuster having a dry belt drive. In cases in which the adjusting mechanism of the camshaft adjuster is designed as a harmonic drive, it can be assembled in the following steps:

- a first, pot-shaped housing part, i.e. a housing pot, and a second, collar-shaped housing part are provided, wherein the first housing part has three regions of different inside diameters, narrowing on the inside toward a housing bottom,
- a stop washer acting as a circumferential stop is press-fitted into the first housing part in the region with the smallest inside diameter,
- an output element of the adjusting mechanism, which is designed as a ring gear, is placed in front of the stop washer, wherein there remains a play in a radial direction relative to the region of the housing pot with the medium inside diameter,
- an internally toothed input ring gear is press-fitted axially in front of the ring gear into the region of the housing pot with the largest inside diameter,
- a flexible mechanism element, which interacts with both ring gears, and a wave generator provided for the purpose of deforming the flexible mechanism element are inserted into the output-side ring gear and into the input ring gear, and
- the second housing part is secured together with the first housing part on an externally toothed input wheel, wherein a static seal inserted between the two housing parts is subjected to pressure, and the connection between the housing parts and the input wheel is established by means of screws arranged radially to the outside of the static seal.

Assembly is possible in a similar way in cases in which the adjusting mechanism is not designed as a harmonic drive but as a three-shaft mechanism of some other design.

The static seal, which seals off the two housing parts from one another irrespective of the type of adjusting mechanism, can be designed as an O-ring seal. A shaped seal with a cross-sectional shape which is more complex than an O-ring seal can likewise be used as a static seal.

In comparison with seal concepts in which the housing of the adjusting mechanism of a camshaft adjuster, which can be rotated as a whole, is sealed off close to the axis of rotation from a non-rotatable component connected to the housing of the electric motor, the disclosure accepts that the dynamic seal which seals off the housing of the electric motor from the mechanism housing has a relatively large diameter. Although, in comparison with seals of smaller dimensions, this is associated with higher relative speeds between surfaces that are sealed off dynamically with respect to one another, it allows a camshaft adjuster construction which is more compact in the axial direction and therefore saves space overall. In one embodiment, the dynamic seal which seals off the housing of the adjusting mechanism from the electric motor rests against a cylindrical lateral surface of the electric motor. The seal can be held on a likewise cylindrical inner wall of the collar-shaped housing part. The whole of the seal can be situated radially to the outside of the stator of the electric motor.

In one embodiment, in addition to making contact with the two housing parts, the static seal makes contact with a ring which is secured on one of the housing parts and is oriented radially inward from the latter. This ring can be secured on the housing part which is designed as a collar-shaped housing cover. Together with the ring, the housing cover describes a T-shaped cross section. As an option, the substantially disk-shaped ring has on the outer circumference thereof a cylindrical shoulder, which makes contact with the likewise cylindrical section of the collar-shaped housing cover. In an advantageous embodiment, the disk-shaped region of the ring which adjoins the cylindrical shoulder contains a large number of openings, which allow the passage of lubricant. Irrespective of the presence of such openings, which can be distributed uniformly over the circumference, the ring can be designed as an axial stop with respect to components of the adjusting mechanism.

By means of a screw fastening arranged radially to the outside of the static seal, the two housing shells can be connected to an externally toothed input wheel, which is designed as a belt pulley provided for dry running. The adjusting mechanism can be lubricated with engine oil. The lubricant can be fed to the adjusting mechanism through the camshaft to be adjusted, for example.

In one embodiment, the two dynamic seals of the electromechanical camshaft adjuster are arranged radially to the inside of the static seal. In this case, the outside diameter of the dynamic seal arranged on the electric motor side can coincide with the medium diameter of the static seal. In contrast, the outside diameter of the dynamic seal which seals with respect to the cylinder head can be smaller than the inside diameter of the dynamic seal which seals with respect to the electric motor. The two dynamic seals can be contact seals.

According to an advantageous embodiment, the housing part of the adjusting mechanism which is sealed off with respect to the cylinder head is designed as a housing pot, in particular sheet-metal pot, which accommodates a plurality of mechanism elements of the adjusting mechanism, wherein the mechanism elements are inserted one after the other into the housing pot in the axial direction—relative to the central axis of the adjusting mechanism. The second housing part is a collar-shaped housing cover, also referred to as a front cover which can be narrower than the housing pot in the axial direction and which is dynamically sealed off directly with respect to the housing of the electric motor. A collar shape refers to a shape which comprises a substantially cylindrical section and a flange, i.e. collar, directed radially outward from this section. The electric motor projects partially into the housing cover, namely into the cylindrical section thereof. This means that there is an overlap in the axial direction between the housing cover of the adjusting mechanism and the electric motor. In particular, this overlap not only pertains between a housing of the electric motor and the housing cover of the adjusting mechanism but also between at least one current-carrying winding of the electric motor and the housing cover.

BRIEF DESCRIPTION OF THE DRAWINGS

An illustrative embodiment of the disclosure is explained in greater detail below with reference to a drawing. In the drawings.

DETAILED DESCRIPTION OF THE EMBODIMENTS

Figure 1:
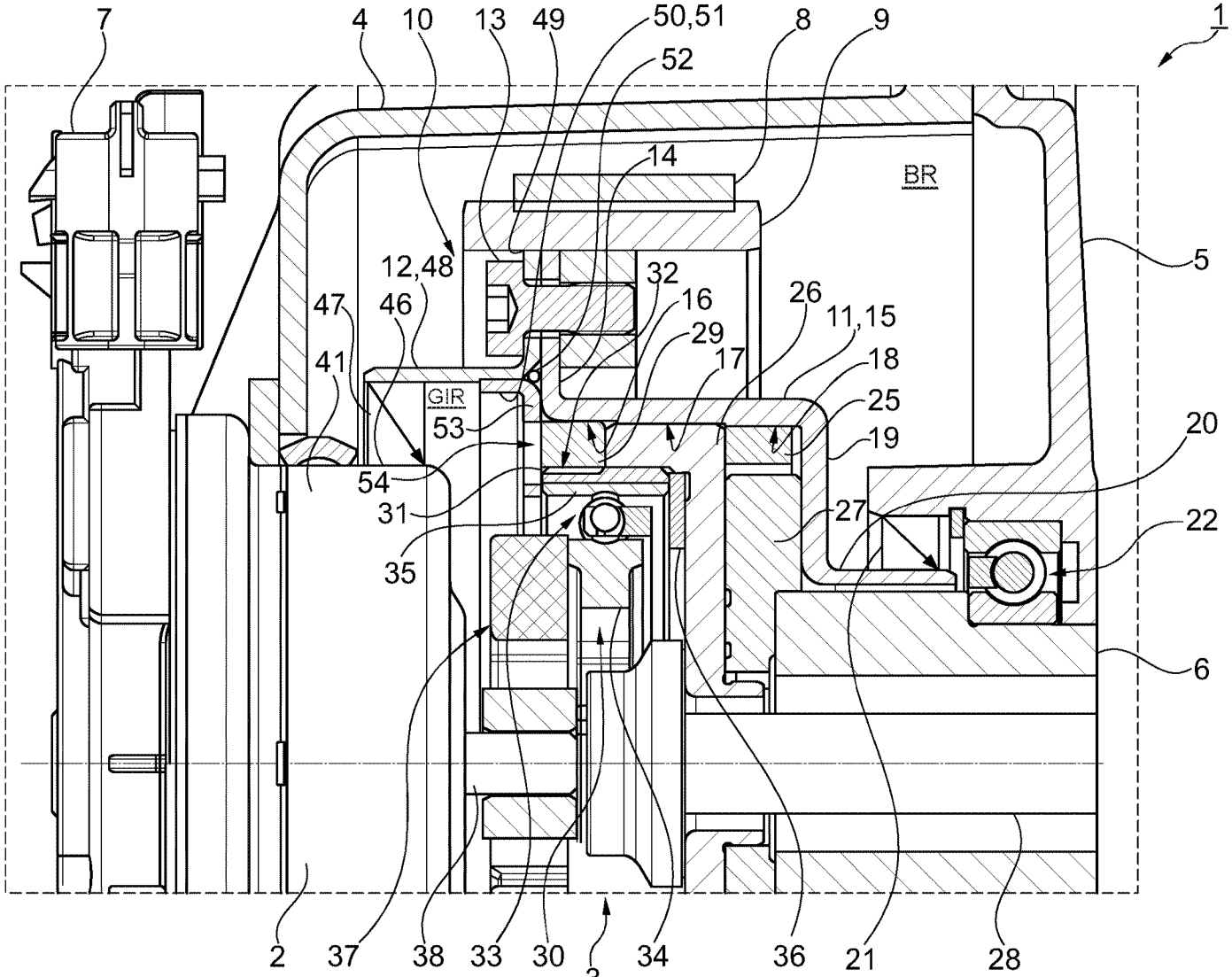
FIG. 1 shows part of an electromechanical camshaft adjuster in section.
Figure 3:
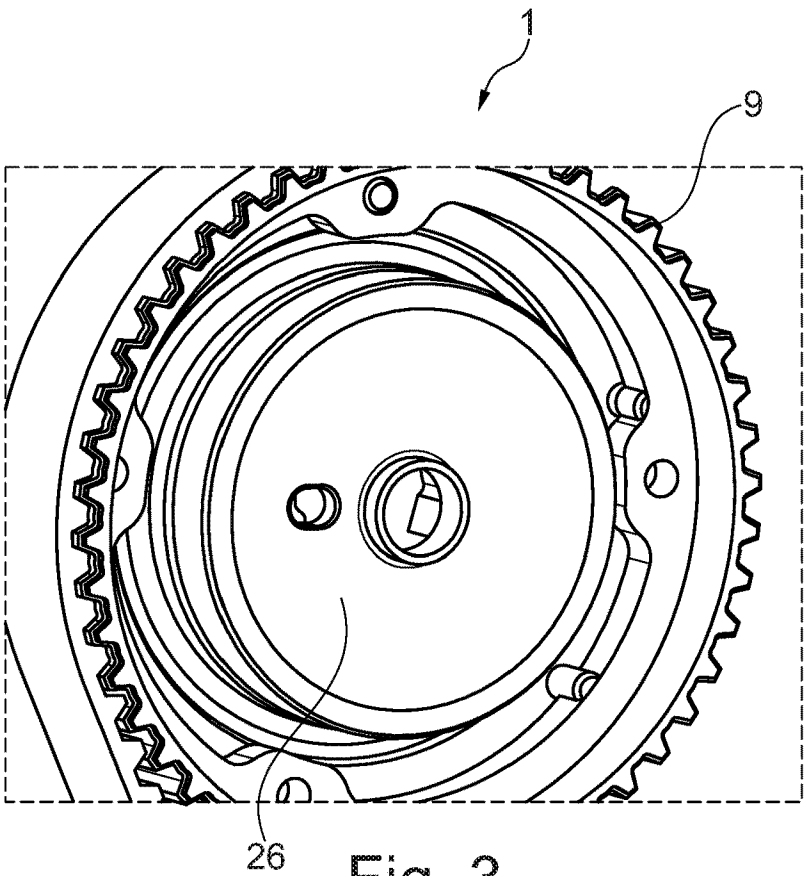
FIGS. 2 to 5 show the camshaft adjuster in various, partially disassembled states, in each case in perspective view.
Figure 2:
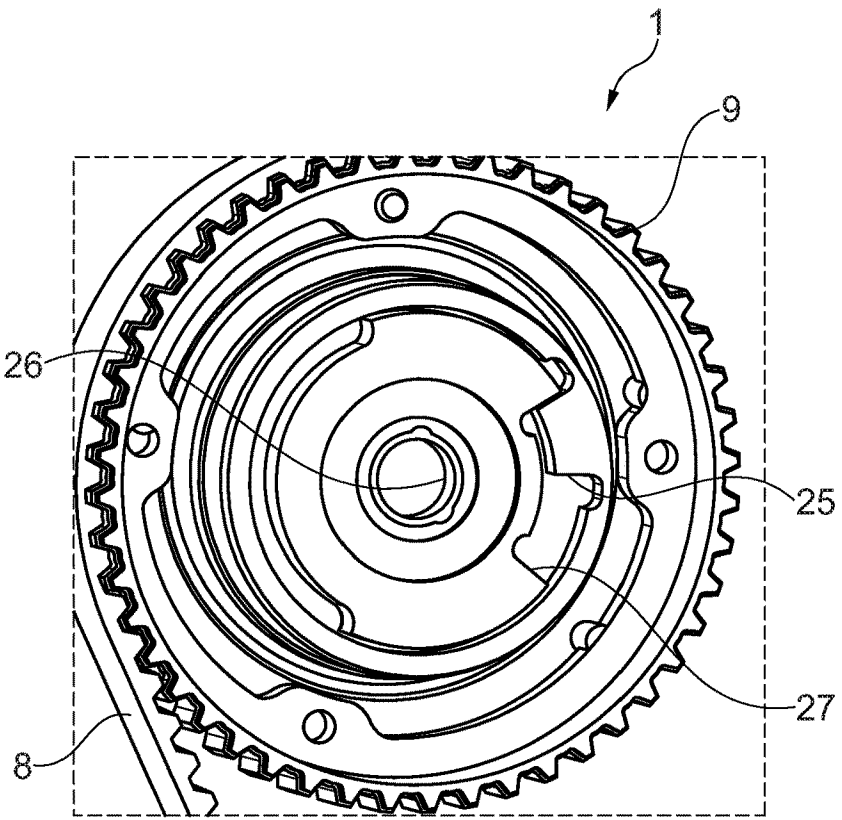
Figure 5:
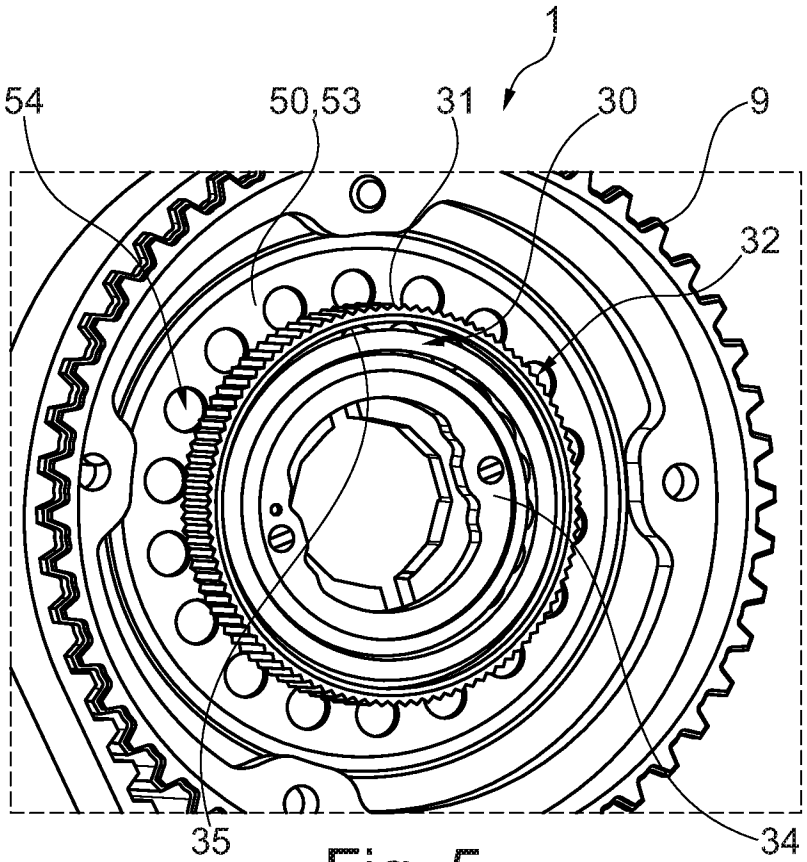
Figure 4:
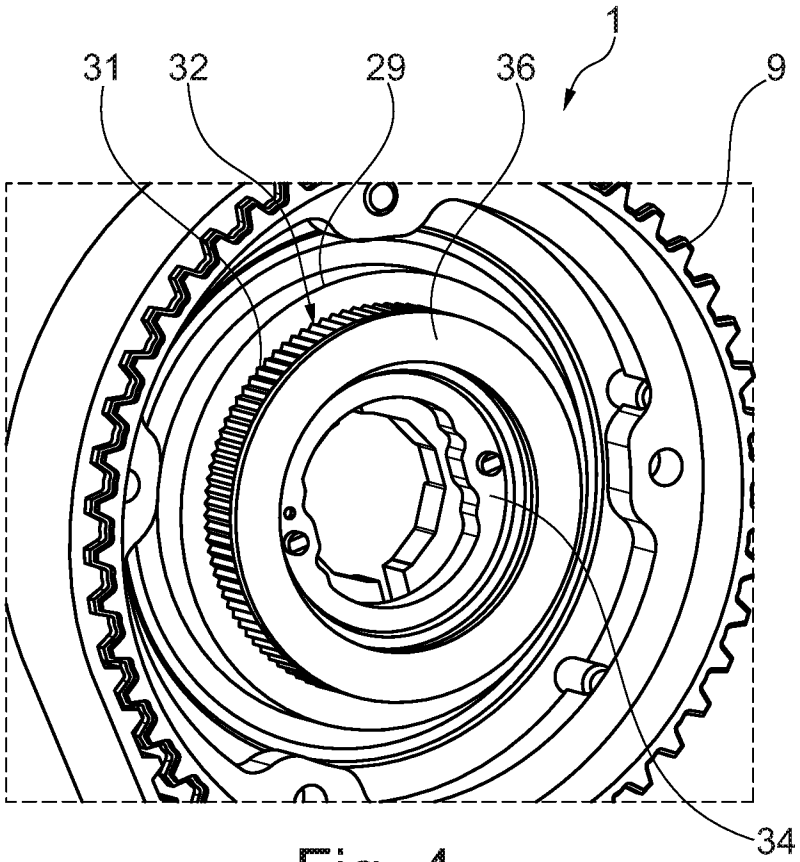

An electromechanical camshaft adjuster denoted overall by the reference sign 1 comprises an electric motor 2 and an adjusting mechanism 3. The electric motor 2 is a brushless DC motor, and the adjusting mechanism 3 is a three-shaft mechanism, namely a harmonic drive. In respect of the basic functioning of the camshaft adjuster 1, reference is made to the prior art cited at the outset.

An outer housing 4 of the camshaft adjuster 1 is secured on a cylinder head 5 of an internal combustion engine, namely a reciprocating-piston engine. The outer housing 4 is a plastic cover, which covers not only the camshaft adjuster 1 but also the associated belt drive, which is explained in greater detail below. The camshaft of the internal combustion engine which is to be adjusted is denoted by 6. The adjusting mechanism 3 and the electric motor 2 are situated completely or very largely within the outer housing 4, wherein a plug housing 7 of the electric motor 2 projects from the outer housing 4. The outer housing 4 surrounds an installation space, denoted by BR, which accommodates the electric motor 2 and the adjusting mechanism 3 and is substantially free from lubricant.

In the installation space BR there is a toothed belt 8, which can be attributed to the belt drive mentioned and which is driven by the crankshaft (not illustrated) of the internal combustion engine. The toothed belt 8 drives an input wheel 9, namely a belt pulley, which is connected firmly to a housing, denoted overall by 10, of the adjusting mechanism 3. The housing 10 is assembled from two housing parts 11, 12 and surrounds a housing interior GIR, which, in contrast to the installation space BR, which is situated outside the housing 10, is lubricated with oil.

The two housing parts 11, 12 are sheet-metal parts made from sheet steel. The first housing part 11 is designed as a housing pot, which accommodates all the components of the adjusting mechanism 3, as will be explained in greater detail below. The second housing part 12 is shaped as a collar-shaped housing cover and has a significantly shorter extent in the axial direction of the adjusting mechanism 3 than the first housing part 11. Both housing parts 11, 12 are screwed to the belt pulley 9 by screws 13, referred to in general as a screw fastening.

The first housing part 11, also referred to as a housing pot, has an outer disk section 14, through which the screws 13 are inserted. Adjoining the inner rim of the outer disk section 14 is a central cylindrical section 15, the inner circumferential surface of which has a plurality of steps. Here, a first axially extending segment or region 16 with the largest inside diameter, a second axially extending segment or region 17 with the medium inside diameter and a third axially extending segment or region 18 with the smallest inside diameter can be distinguished from one another. The region 16 with the largest inside diameter adjoins the outer disk section 14, while the region 18 with the smallest inside diameter adjoins a housing bottom 19. Overall, the interior of the housing pot 11 thus narrows toward the housing bottom 19. Adjoining the housing bottom 19 is an inner cylindrical section 20, which directly surrounds the camshaft 6.

The inner cylindrical section 20 is contacted on the outside diameter thereof by a dynamic seal 21, which seals off the housing 10 on the cylinder head side. Adjacent to the seal 21 and the inner cylindrical section 20 there is a rolling bearing 22, by means of which the camshaft 6 is mounted in the cylinder head 5.

The actuating mechanism 3, which is designed as a harmonic drive, is configured in such a way that only limited relative rotation between the camshaft 6 and the housing 10 is possible. For this purpose, an end stop ring 25, also referred to as a stop washer, is press-fitted into the housing pot 11 and held in the region 18 with the smallest inside diameter, close to the housing bottom 19. Press-fitting in the region 18 with the smallest diameter not only tends to lead to an expansion of the narrowest region 18 but also to an expansion of the region 17 with the medium inside diameter. The consequences of this expansion are controlled with the aid of the stepping of regions 16, 17 and 18, even under conditions of series production.

After the end stop ring 25 has been secured in the housing pot 11, an output ring gear 26 is inserted with play into the housing part 11. A circumferential stop element 27 is placed in front of the output ring gear 26, which stop element, being coupled to the output ring gear 26 for conjoint rotation therewith, interacts as a stop element with the end stop ring 25. The subassembly comprising the output ring gear 26 and the circumferential stop element 27 is secured on the camshaft 6 by means of a central screw 28. A cylindrical outer circumferential surface of the output ring gear 26 is situated with play in the radial direction within the region 17 with the medium inside diameter.

After the unit comprising the output ring gear 26 and the circumferential stop element 27 has been inserted into the housing pot 11, an input ring gear 29 is press-fitted into said pot. By means of the press-fit process, the input ring gear 29 is held permanently for conjoint rotation in the region 16 with the largest inside diameter, wherein—as with the press-fitting of the end stop ring 25—the press fit process can also affect the dimensioning of the region 17 with the medium inside diameter, this being taken into account in the design of the stepped regions 16, 17, 18.

A wave generator 30 of a design known per se and a flexible mechanism element 31, referred to for short as a flex ring, are mounted radially to the inside of the input ring gear 29 and of the likewise internally toothed output ring gear 26. External toothing, referred to by 32, of the flex ring 31 engages in a manner which is known per se in principle in two diametrically opposite circumferential sections of internal toothing of the output ring gear 26 and of the input ring gear 29. The wave generator 30 forces the flex ring 31 continuously into a shape that deviates from a circular shape. The interaction between the flex ring 31 and the input ring gear 29 is referred to as the coupling stage, while the interaction between the flex ring 31 and the output ring gear 26 is referred to as the reduction stage of the harmonic drive 3. The wave generator 30 comprises a ball bearing 33, the inner ring of which is denoted by 34.

In contrast to the inner ring 34, the outer ring, denoted by 35, of the ball bearing 33 is elastically flexible. The end face of the outer ring 35 which is situated on the open side of the housing pot 11 is in the same plane as the end face of the input ring gear 29 which is situated on the same side. This is the plane in which the end face of the outer disk section 14 is also situated. At the opposite end of the wave generator 30 there is a stop washer 36 acting in the axial direction.

The inner ring 34 is driven via a compensating coupling 37, namely an Oldham coupling, which, in the illustrative embodiment, projects partially into the interior of the housing pot 11. Instead of an Oldham coupling, a single-finger coupling can also be used as a compensating coupling 37, for example.

The compensating coupling 37 is driven by an adjusting shaft 38, which is identical with the motor shaft of the electric motor 2 in the illustrative embodiment. The adjusting shaft 38 is arranged concentrically with the camshaft 6 and projects partially into the interior of the housing pot 11. With the aid of two rolling bearings (not illustrated), namely ball bearings, the adjusting shaft 38 is mounted in the electric motor housing, which is denoted by 41. A sliding seal (likewise not illustrated) seals off the interior of the electric motor 2 with respect to the oil-lubricated interior GIR of the housing 10. The electric motor 2 is configured as an internal rotor motor. The stator of the electric motor 2 has current-carrying windings 44, which are not visible in FIG. 1.

The outer circumferential surface of the electric motor housing 41, which is denoted by 46, is contacted by a dynamic seal 47 on the electric-motor side. Just like the seal 21 on the cylinder-head side, the seal 47 on the electric-motor side is designed as a double-lip contact seal in the illustrative embodiment. In both cases, the use of other types of seal may also be considered.

The seal 47 is secured in a cylindrical section 48 of the second, collar-shaped housing part 12. Adjoining the cylindrical section 48 on the side facing away from the electric motor 2 is a flange section 49, which together with the outer disk section 14 is screwed firmly to the input wheel 9 with the aid of the screws 13.

In comparison with the first housing part 11, the second housing part 12, which is also referred to as the housing cover, has a simpler shape, wherein it is narrower in the axial direction of the adjusting mechanism 3.

The electric motor 2 projects partially into the second housing part 12 and hence into the housing interior GIR. This means that there is an overlap between the electric motor 2 and the housing cover 12 in the axial direction.

There is a common plane normal to the axis of rotation of the adjusting shaft 38 and hence also to the central axis of the camshaft 6, which plane intersects both the electric motor housing 41 and the seal 47 and the cylindrical section 48 of the collar-shaped housing part 12.

In the illustrative embodiment shown, the inside diameter of the cylindrical section 48 is larger than the outside diameter of the central cylindrical section 15 of the housing pot 11. Accordingly, the flange section 49 has a shorter extent in the radial direction than the outer disk section 14, which ends flush with the flange section 14 on the outside. In the inner region of the outer disk section 14 there remains a region which is not covered by the flange section 49 and which is contacted by a ring 50 that is held on the housing cover 12. On the outer rim of the ring 50, said ring has an annularly encircling shoulder 51, which rests against the inside of the cylindrical section 48.

A space of approximately triangular cross section, into which a static seal 52, namely an O-ring seal, is inserted, is formed between the outer rim of the ring 50, the transitional region between the cylindrical section 48 and the flange section 49 of the housing cover 12, and the outer disk section 14 of the housing pot 11. As the screws 13 are tightened, this seal 52 is compressed slightly, whereby the entire housing interior GIR is sealed off statically by a single sealing element.

A stop section 53 of the ring 50, said section being in the form of an annular disk, adjoins the shoulder 51 radially toward the inside. Within the subsection 53 there are circular openings 54, which allow lubricant to pass through. In its radially inner region, the stop section 53 serves as an axial stop with respect to the outer ring 35 and with respect to the flex ring 31.

Figure 7:
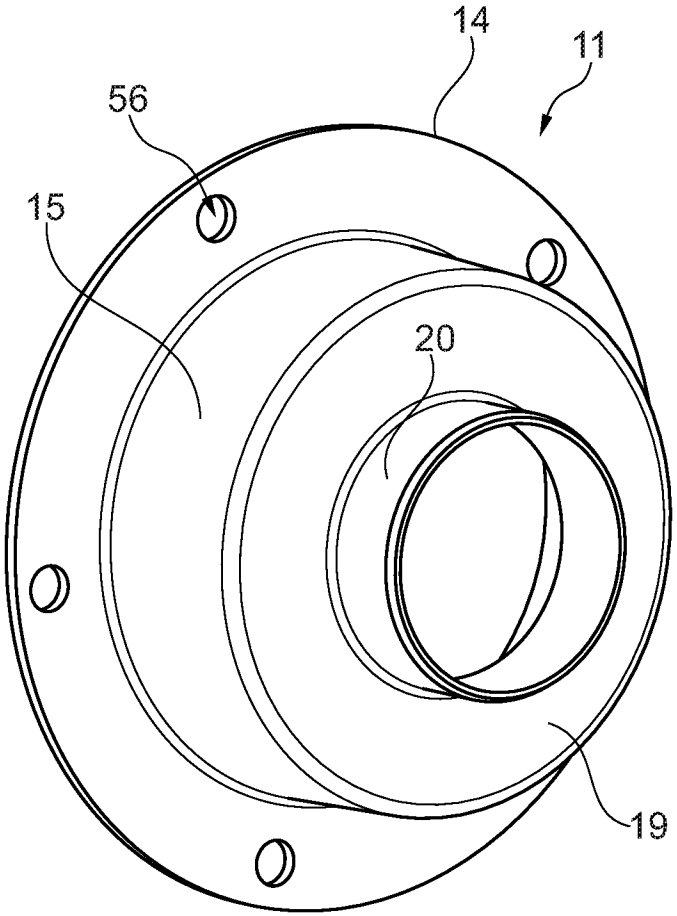
FIGS. 6 and 7 show a housing part of the camshaft adjuster, said part being designed as a sheet-metal pot.
Figure 6:
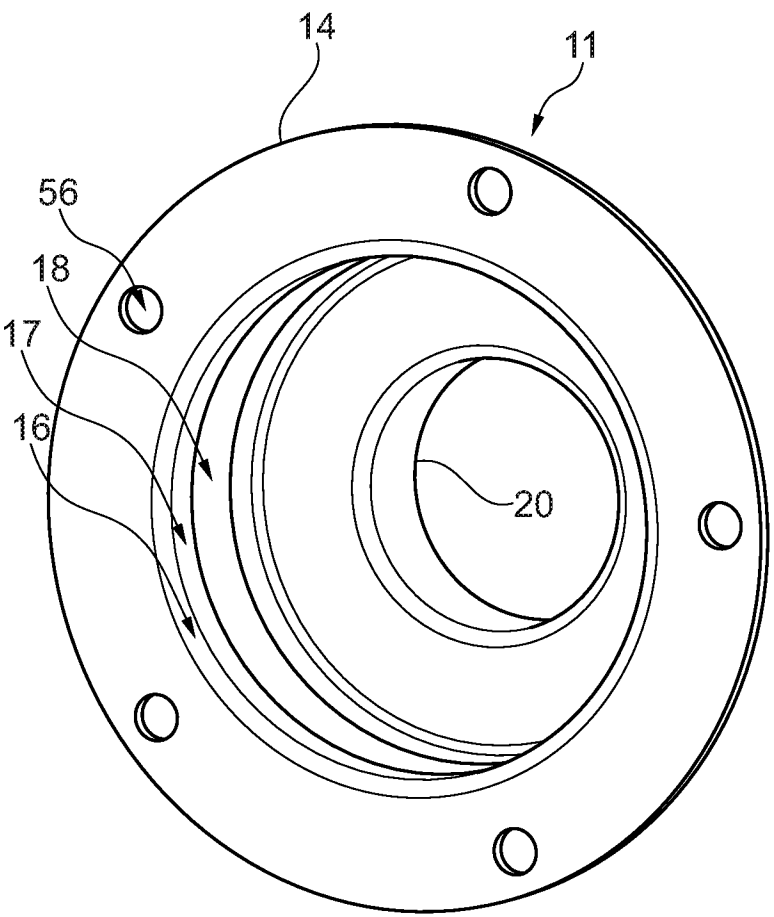
Figure 9:
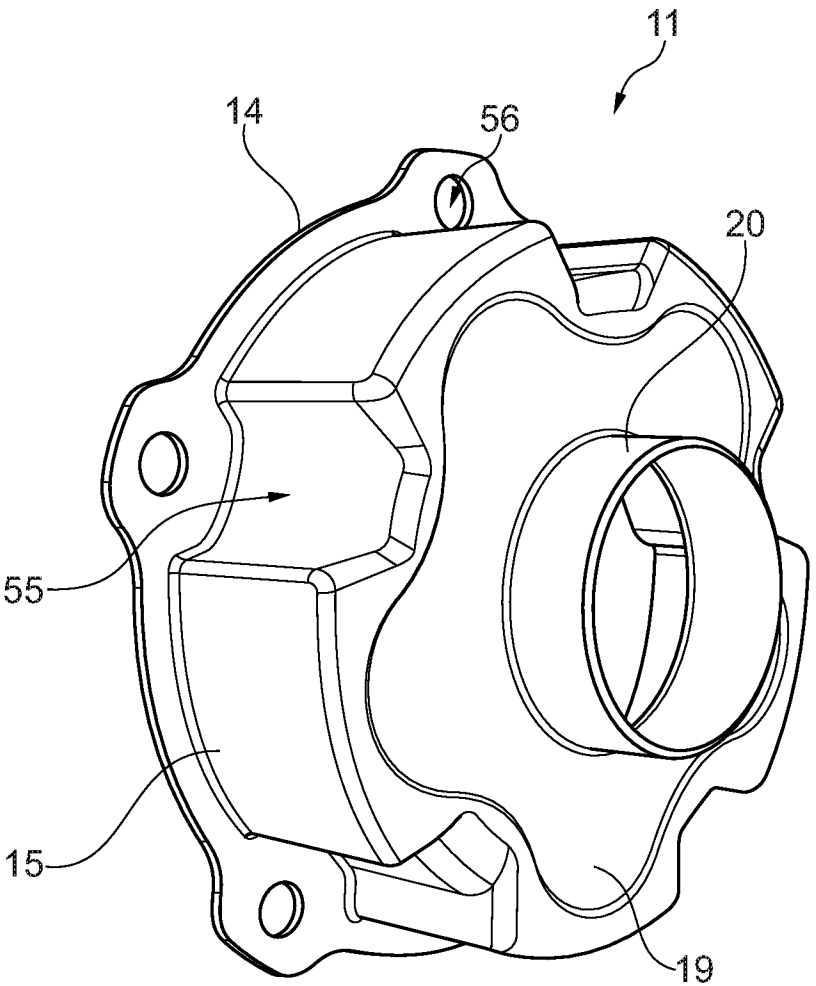
FIGS. 8 and 9 show a modified embodiment of the pot-shaped housing part in illustrations similar to FIGS. 6 and 7.
Figure 8:
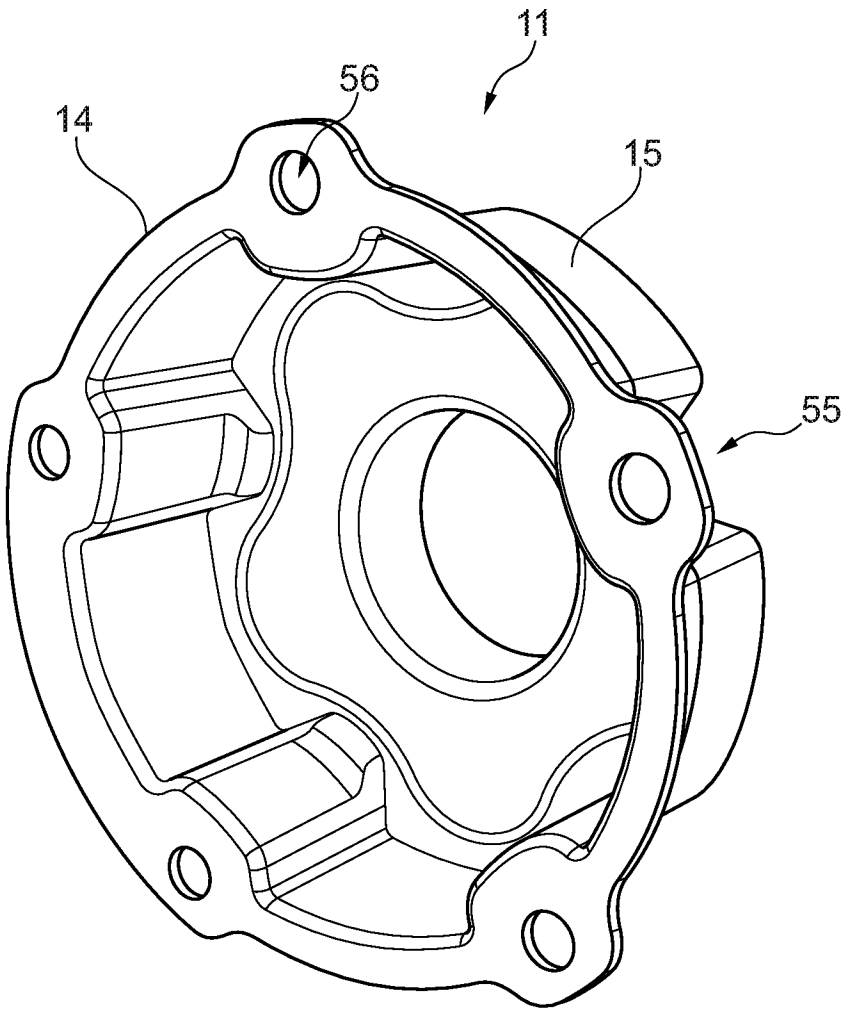

FIGS. 8 and 9 show a modified geometric configuration of the housing pot 11, which is likewise suitable for the camshaft adjuster 1 shown in FIGS. 1 to 5 as a substitute for the variant shown in FIGS. 6 and 7. In contrast to the variant shown in FIGS. 6 and 7, the housing pot shown in FIGS. 8 and 9 has a plurality of cut-outs 55, i.e. regions of reduced diameter, within the central cylindrical section 15. Here, each cut-out 55 is situated radially to the inside of a fastening opening, denoted by 56, in the outer disk section 14. As a departure from the embodiment shown in FIGS. 8 and 9, there could also be an offset in the circumferential direction between the cut-outs 55, on the one hand, and the fastening openings 56, on the other hand.

On the inside of the central cylindrical section 15, the end stop ring 25, which is not illustrated in FIGS. 8 and 9, makes contact with the housing part 11 only in individual circumferential sections, facilitating the press-fit process. Similarly, the output ring gear 26 is supported by the first housing part 11 in the radial direction only in individual, mutually separate circumferential sections. As an alternative to an end stop ring 25 with a circular outer circumference, an end stop ring 25 with a contour matched to the shape of the cutouts 55 can also be inserted into the housing part 11, ensuring play-free positive engagement between the end stop ring 25 and the housing pot 11 in the circumferential direction. Here, the positive engagement is configured in such a way that a press-fit joint arises in the tangential direction, instead of the radial direction. This minimizes deformations, in particular expansion, of the housing part 11, wherein a gap is formed between the end stop ring 25 and the housing pot 11 in circumferential sections outside the cutouts 55. In corresponding fashion, the input ring gear 29 can also either have a circular outer contour or a contour matched to the inner contour of the housing pot 11 with a view to positive engagement.

LIST OF REFERENCE CHARACTERS

1 camshaft adjuster
2 electric motor
3 adjusting mechanism, harmonic drive
4 outer housing
5 cylinder head
6 camshaft
7 plug housing
8 toothed belt
9 input wheel, belt pulley
10 housing
11 first housing part, pot-shaped
12 second housing part, housing cover
13 screw, screw fastening
14 outer disk section
15 central cylindrical section
16 region with the largest inside diameter
17 region with the medium inside diameter
18 region with the smallest inside diameter
19 housing base
20 inner cylindrical section
21 dynamic seal, on the cylinder-head side
22 rolling bearing
25 end stop ring, stop washer
26 output ring gear
27 circumferential stop element
28 central screw
29 input ring gear
30 wave generator
31 flex ring, flexible mechanism element
32 external toothing
33 ball bearing
34 inner ring
35 outer ring
36 stop washer
37 compensating coupling
38 adjusting shaft
41 electric motor housing
46 outer circumferential surface
47 dynamic seal, on the electric-motor side
48 cylindrical section
49 flange section
50 ring
51 shoulder
52 static seal
53 stop section
54 opening
55 cut-out
56 fastening opening
BR installation space
GIR housing interior

The invention claimed is:

1. An electromechanical camshaft adjuster, comprising:

an electric motor; and, an adjusting mechanism actuated by said electric motor, the adjusting mechanism including a housing having a first pot-shaped housing part and a second housing part, the first pot-shaped housing part having three different inside diameter regions, wherein a stop washer is held in a first region with a smallest inside diameter, an output ring gear is mounted with play in a second region with a medium inside diameter, and an input ring gear is arranged in a third region with a largest inside diameter, and, the electric motor partially projects into the second housing part.

2. The electromechanical camshaft adjuster as claimed in claim 1, further comprising a static seal arranged to contact: i) the first and second housing parts; and, ii) a ring which is secured on one of the first or second housing parts.

3. The electromechanical camshaft adjuster as claimed in claim 2, wherein the ring has a multiplicity of circumferential openings.

4. The electromechanical camshaft adjuster as claimed in claim 2, wherein the ring is designed as an axial stop for components of the adjusting mechanism.

5. The electromechanical camshaft adjuster as claimed in claim 2, wherein the first and second housing parts are connected by a fastener to an externally toothed input wheel wherein the fastener is arranged radially to an outside of the static seal.

6. The electromechanical camshaft adjuster as claimed in claim 5, further comprising first and second dynamic seals that do not project outward in a radial direction beyond the static seal.

7. The electromechanical camshaft adjuster as claimed in claim 6, wherein an outside diameter of the first dynamic seal arranged on an electric motor side of the housing corresponds to the medium inside diameter of the static seal.

8. The electromechanical camshaft adjuster as claimed in claim 1, wherein a harmonic drive is provided as the adjusting mechanism.

9. The electromechanical camshaft adjuster as claimed in claim 1, wherein the housing is lubricated with oil.

10. The electromechanical camshaft adjuster as claimed in claim 1, wherein the housing is configured to seal against a cylinder head of an internal combustion engine.

11. An electromechanical camshaft adjuster, comprising:

an electric motor; and, an adjusting mechanism actuated by the motor, the adjusting mechanism including a housing having a first housing part and a second housing part, the first housing part having three different inside diameter axially extending segments, wherein a stop washer is secured in a first axially extending segment with a first inside diameter, an output ring gear is mounted with play in a second axially extending segment with a second inside diameter larger than the first inside diameter, and an input ring gear is arranged in a third axially extending segment with a third inside diameter larger than the second inside diameter.

12. The electromechanical camshaft adjuster as claimed in claim 11, wherein the first housing part is fastened to the second housing part.

13. The electromechanical camshaft adjuster as claimed in claim 11, wherein the third axially extending segment is arranged between the second axially extending segment and the electric motor.

14. The electromechanical camshaft adjuster as claimed in claim 11, wherein the output ring gear is configured to be secured to a camshaft.

15. The electromechanical camshaft adjuster as claimed in claim 11, wherein the stop washer is configured to stop the output ring gear.

16. The electromechanical camshaft adjuster as claimed in claim 15, further comprising a circumferential stop element coupled to the output ring gear, the circumferential stop element configured to interact with the stop washer.

17. The electromechanical camshaft adjuster as claimed in claim 11, wherein the housing is configured with a plurality of individual circumferential sections that radially support the output ring gear.

18. The electromechanical camshaft adjuster as claimed in claim 11, wherein the housing is configured to seal against the electric motor.

19. A method for assembling an adjusting mechanism, arranged as a harmonic drive, of an electromechanical camshaft adjuster, the method comprising:

providing a first pot-shaped housing part and a second collar-shaped housing part, the first housing part having three regions of different inside diameters, press-fitting a stop washer into the first housing part in a region with a smallest inside diameter, the stop washer arranged as a circumferential stop, arranging an output element of the adjusting mechanism with radial play relative to a region of the first housing part with a medium inside diameter, the output element configured as a ring gear and placed in front of the stop washer, press-fitting an internally toothed input ring gear in front of the output element into a region of the first housing part (11) with a largest inside diameter, inserting a flexible mechanism element and a wave generator into the output element and input ring gear, the flexible mechanism element arranged to interact with the output element and input ring gear, and the wave generator arranged to deform the flexible mechanism element, securing the second housing part together with the first housing part on an externally toothed input wheel, wherein a static seal inserted between the first and second housing parts is subjected to pressure, and a connection between the housing first and second housing parts and the input wheel is established by fasteners arranged radially outside of the static seal.

* * * * *